US007494476B2

(12) United States Patent
Wong et al.

(10) Patent No.: US 7,494,476 B2
(45) Date of Patent: Feb. 24, 2009

(54) FOOT MASSAGE APPARATUS

(75) Inventors: Thomas K. S. Wong, Hong Kong (CN); Joanne W. Y. Chung, Hong Kong (CN); Sonny H. M. Tse, Hong Kong (CN); Ka Lun Fan, Hong Kong (CN); Ching Ching Cheung, Hong Kong (CN); Pony Ma, Hong Kong (CN); Yin Ki Lau, Hong Kong (CN); Sarah W. M. Au, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 316 days.

(21) Appl. No.: 11/244,254

(22) Filed: Oct. 5, 2005

(65) Prior Publication Data

US 2007/0078361 A1 Apr. 5, 2007

(51) Int. Cl.
*A61H 23/02* (2006.01)
*A61H 1/00* (2006.01)

(52) U.S. Cl. ..... 601/98; 601/103; 601/111

(58) Field of Classification Search ..... 601/27, 601/28, 29, 30, 31, 32, 49, 51, 98, 100, 101, 601/103, 104, 108, 111
See application file for complete search history.

(56) References Cited

U.S. PATENT DOCUMENTS 5,158,073 A 10/1992 Bukowski
5,605,533 A 2/1997 Badilla
5,681,266 A * 10/1997 Lin ..... 601/104
6,602,212 B1 8/2003 Ahn

* cited by examiner

*Primary Examiner*—Danton DeMille
(74) *Attorney, Agent, or Firm*—Merchant & Gould P.C.

(57) ABSTRACT

A foot massage apparatus comprises: a housing (5); a pair of replaceable footprint plates (4) with holes (40) arranged according to a particular foot massage pattern, which are placed on an upper plate (51) of the housing (5); protrusions (2; 3) protruding from the holes (40) of each replaceable footprint plate (4); a vertical adjustment mechanism provided in the housing (5), for adjusting the height of the protrusions (2; 3); a horizontal adjustment mechanism provided in the housing (5), for adjusting the horizontal position of the protrusions (2; 3); and a driving mechanism provided in the housing (5), for driving the protrusions (2; 3) to move up and down cyclically. The foot massage apparatus of the present invention has the advantages of enhancing a particular bodily function and fitting different foot sizes.

6 Claims, 5 Drawing Sheets

FOOT MASSAGE APPARATUS

TECHNICAL FIELD

The present invention relates to acupressure massage apparatus, more particularly to a foot massage apparatus for personal homecare applications, which is capable of enhancing a particular bodily function.

BACKGROUND ART

Generally, a foot massage apparatus is of healthcare product by integrating the foot reflexology and acupressure theory derived from the complementary medicine and Traditional Chinese Medicine (TCM). Foot reflexology is based on the premise that nerve endings run in the feet have links to the internal organs and other body parts. That is, there are some reflex zones on the feet. The acupressure means that pressure is applied to the selected acupoint(s) to elicit feelings of numbness, pressure sensation, heaviness, soreness, or distention (De Qi sensation). The Yung Quan (KI1) acupoint is selected as it is the only acupoint on the sole. Appropriate stimulation to the acupoint(s) will have effects on other body parts through the meridians. By stimulating a combination of different reflex zones and the KI acupoint, different therapeutic effects on various body ailments and pain reduction could be obtained. Therefore, foot massage apparatus would greatly benefit the health of human body in particular ways. In the prior art, there are various foot massage apparatus. For example, U.S. Pat. No. 6,602,212 discloses a foot massage which is capable of performing various massages by using either water pressure or air pressure. U.S. Pat. No. 5,518,073 discloses an acupressure foot massage mat on which identical hemispherical protrusions made of resilient material are randomly located; the massage effect is provided when a user is walking or resting on the mat. U.S. Pat. No. 5,605,533 discloses a touch-activated foot massage device consisting of a plurality of rubber balls driven by crankshafts, in which the balls are uniformly located and the up-and-down motions of the balls are activated by the crankshafts which are connected to the motor by means of a tooth belt.

However, the above-mentioned foot massage apparatuses are used to make comprehensive foot massage for general purpose, not to enhance a particular bodily function, such as blood circulation, migraine and weight reduction.

CONTENTS OF THE INVENTION

An object of the present invention is to provide a foot massage apparatus for personal homecare applications, which is capable of enhancing a particular bodily function and fitting different foot sizes.

In order to achieve the above-mentioned object of the present invention, there is provided a foot massage apparatus, which comprises: a housing; a pair of replaceable footprint plates with holes arranged according to a particular foot massage pattern, which are placed on an upper plate of the housing; protrusions protruding from the holes of each replaceable footprint plate; a vertical adjustment mechanism provided in the housing, for adjusting the height of the protrusions; a horizontal adjustment mechanism provided in the housing, for adjusting the horizontal position of the protrusions; and a driving mechanism provided in the housing, for driving the protrusions to move up and down cyclically.

According to the above-mentioned foot massage apparatus, wherein the vertical adjustment mechanism includes: a pair of first intermediate levers, first ends of which are provided with actuator columns for supporting protrusions thereon; a pair of second intermediate levers, first ends of which are provided with actuator columns for supporting protrusions thereon; a main lever connected with second ends of the first intermediate levers and second ends of the second intermediate levers by means of a pivot shaft; a first adjustment knob connected to the main lever, for adjusting the initial height of the protrusions.

According to the above-mentioned foot massage apparatus, wherein a bottom end of the first adjustment knob with screw thread is connected to a nut mounted on the main lever.

According to the above-mentioned foot massage apparatus, wherein the horizontal adjustment mechanism includes a second adjustment knob passing through a side plate of the housing and being connected with inner plates mounted in the housing, for adjusting the horizontal position of the protrusions in order to suit different foot sizes; a pair of horizontally movable plates which are connected with the inner plates and on which are provided with corresponding holes for respectively allowing the actuator columns to protrude therethrough; support columns mounted on a bottom plate of the housing, for supporting the horizontally movable plates; horizontally pivot levers, first ends of which are pivotedly connected to the support columns, and second ends of which are pivotedly connected to the bottom of the horizontally movable plates.

According to the above-mentioned foot massage apparatus, wherein the horizontally movable plates are connected with the inner plates via pin elements passing through ellipse holes of the inner plates.

According to the above-mentioned foot massage apparatus, wherein the driving mechanism includes an electric motor and cams which are synchronously driven by the electric motor, for supporting and thereby driving the first intermediate levers and the second intermediate levers together with the actuator columns and protrusions mounted thereon to move up and down cyclically.

According to the above-mentioned foot massage apparatus, wherein protrusion plates with the corresponding massage pattern are further fixed between the actuator columns and the protrusions by inserting bottom ends of the protrusions into the actuator columns through holes in the protrusion plates.

Compare with the prior art, the foot massage apparatus of the present invention has the advantages of enhancing a particular bodily function and fitting different foot sizes.

PREFERRED EMBODIMENTS OF CARRYING OUT THE INVENTION

Figure 1:
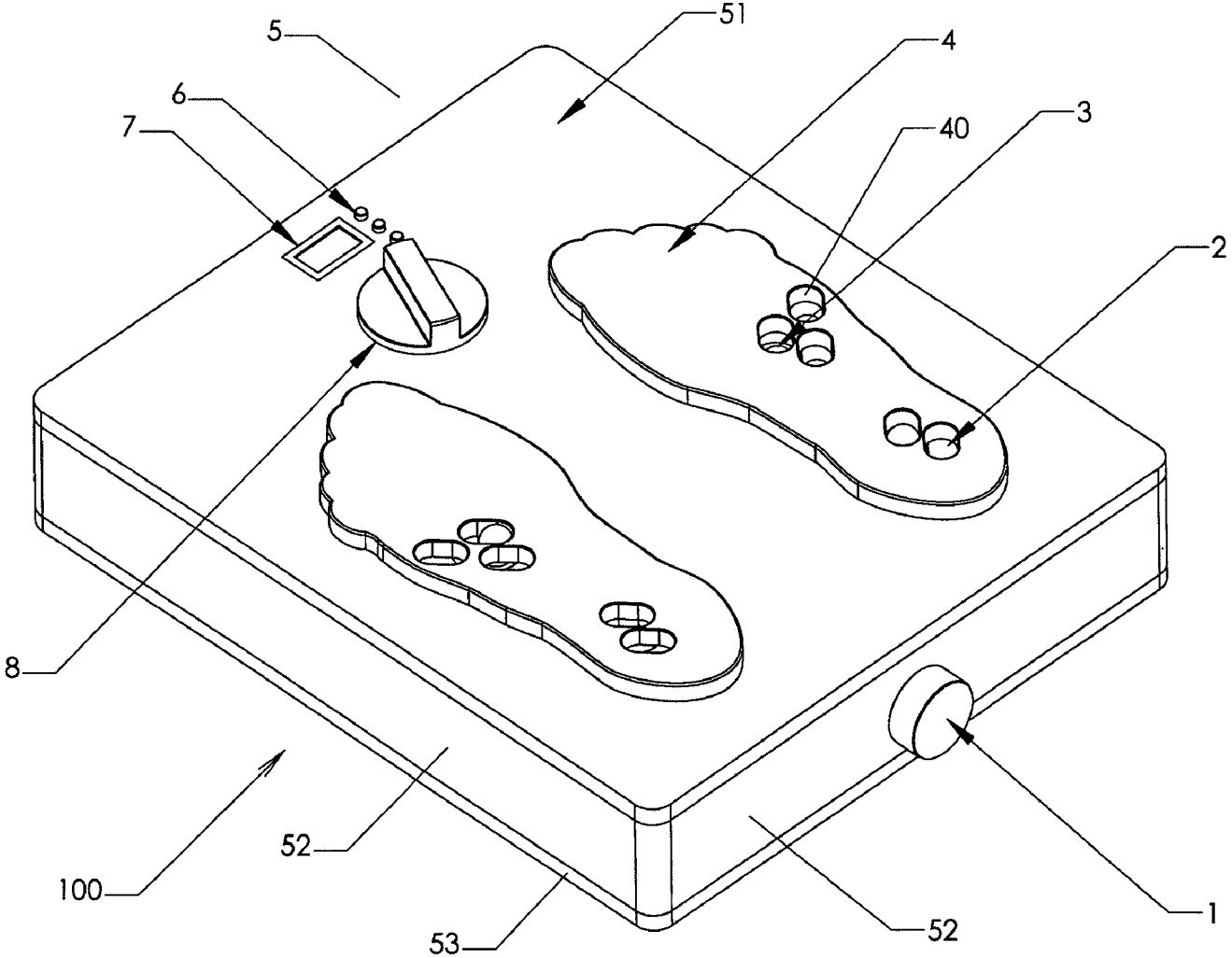
FIG. 1 is a perspective view illustrating a foot massage apparatus according to an embodiment of the present invention.
Figure 2:
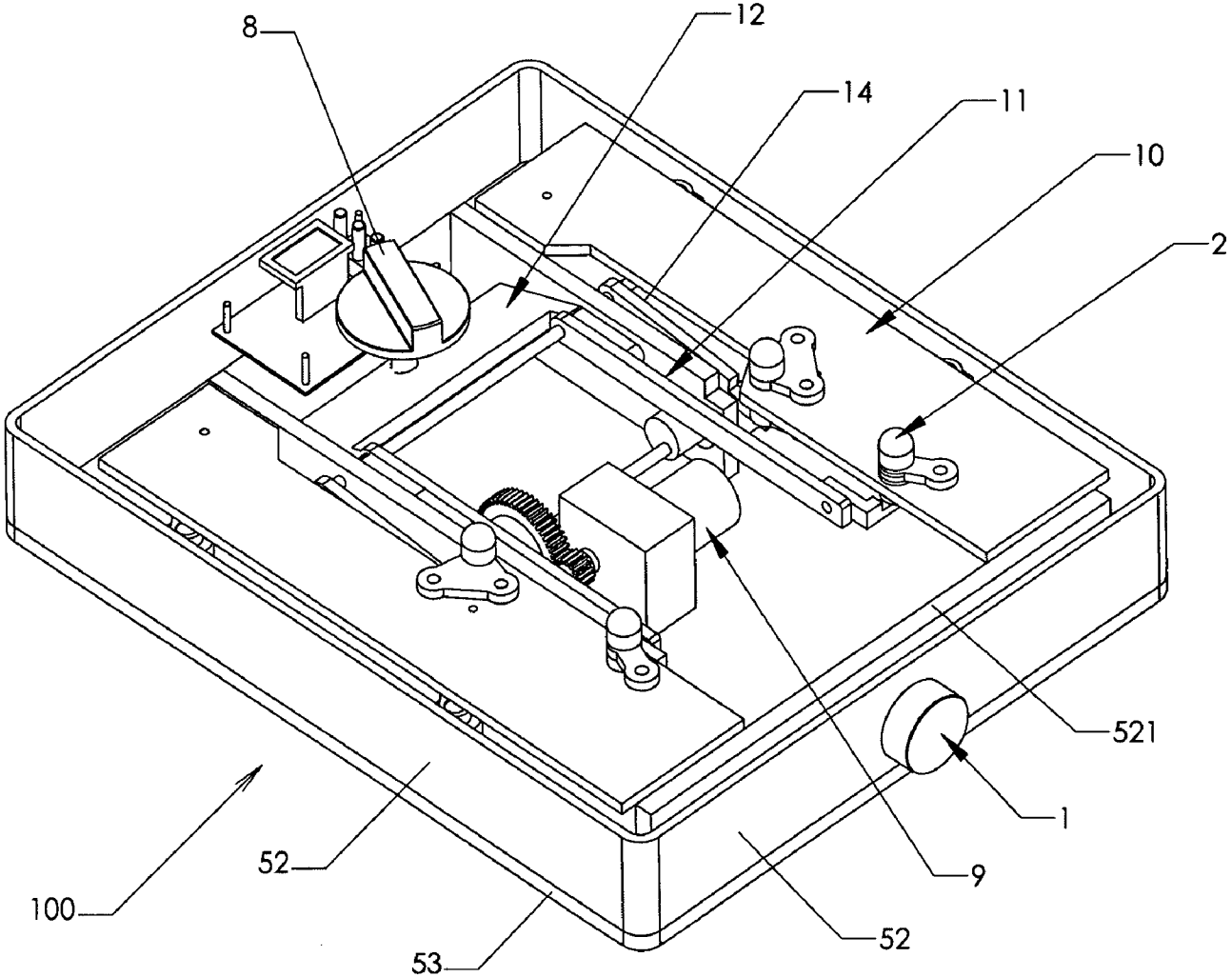
FIG. 2 is a perspective view illustrating the inner structure of the foot massage apparatus shown in FIG. 1, removing the upper plate of the housing.
Figure 3:
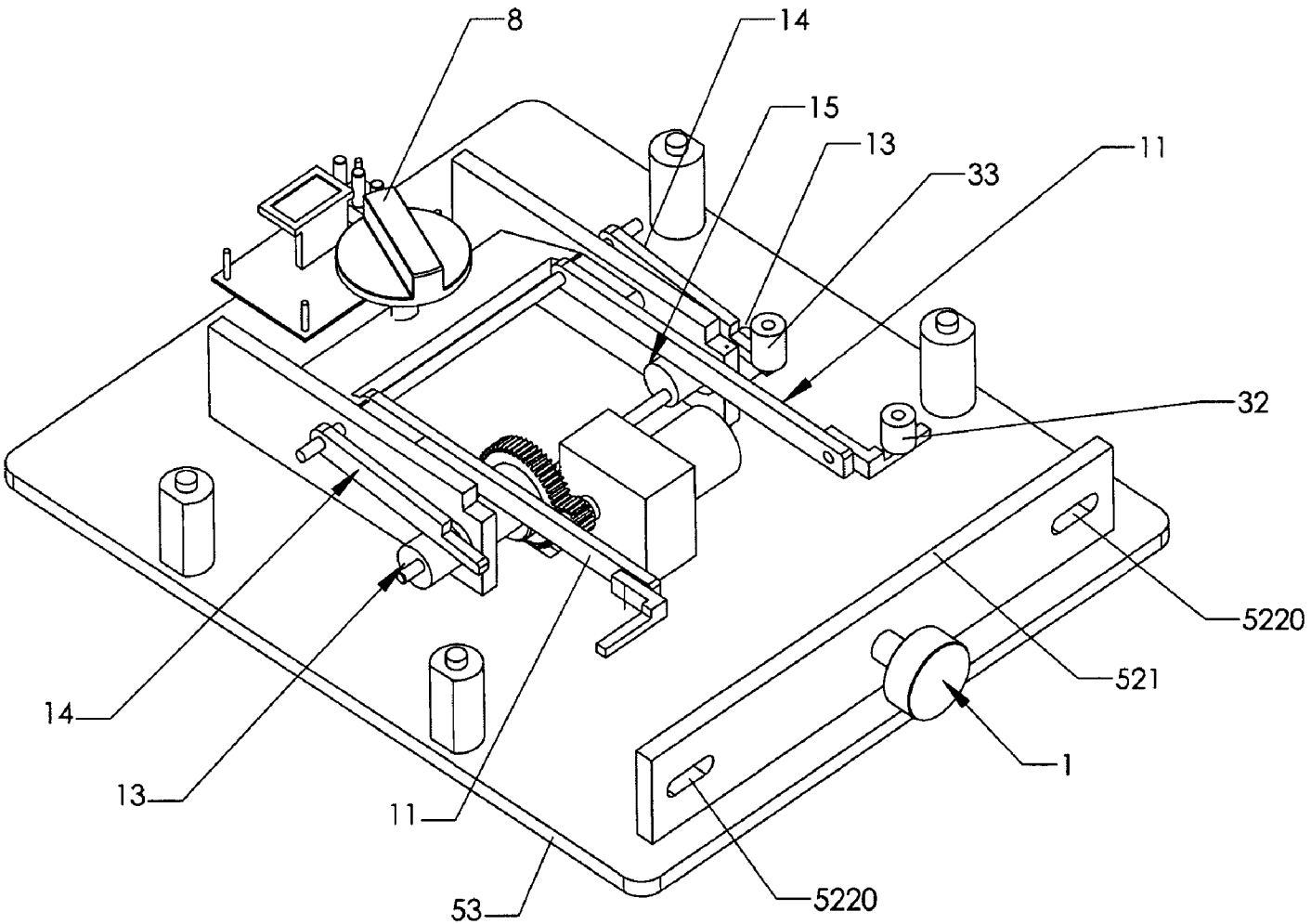
FIG. 3 is a perspective view illustrating the inner structure of the foot massage apparatus shown in FIG. 1, removing the upper plate, the horizontally movable plates and the side plates.
Figure 4:
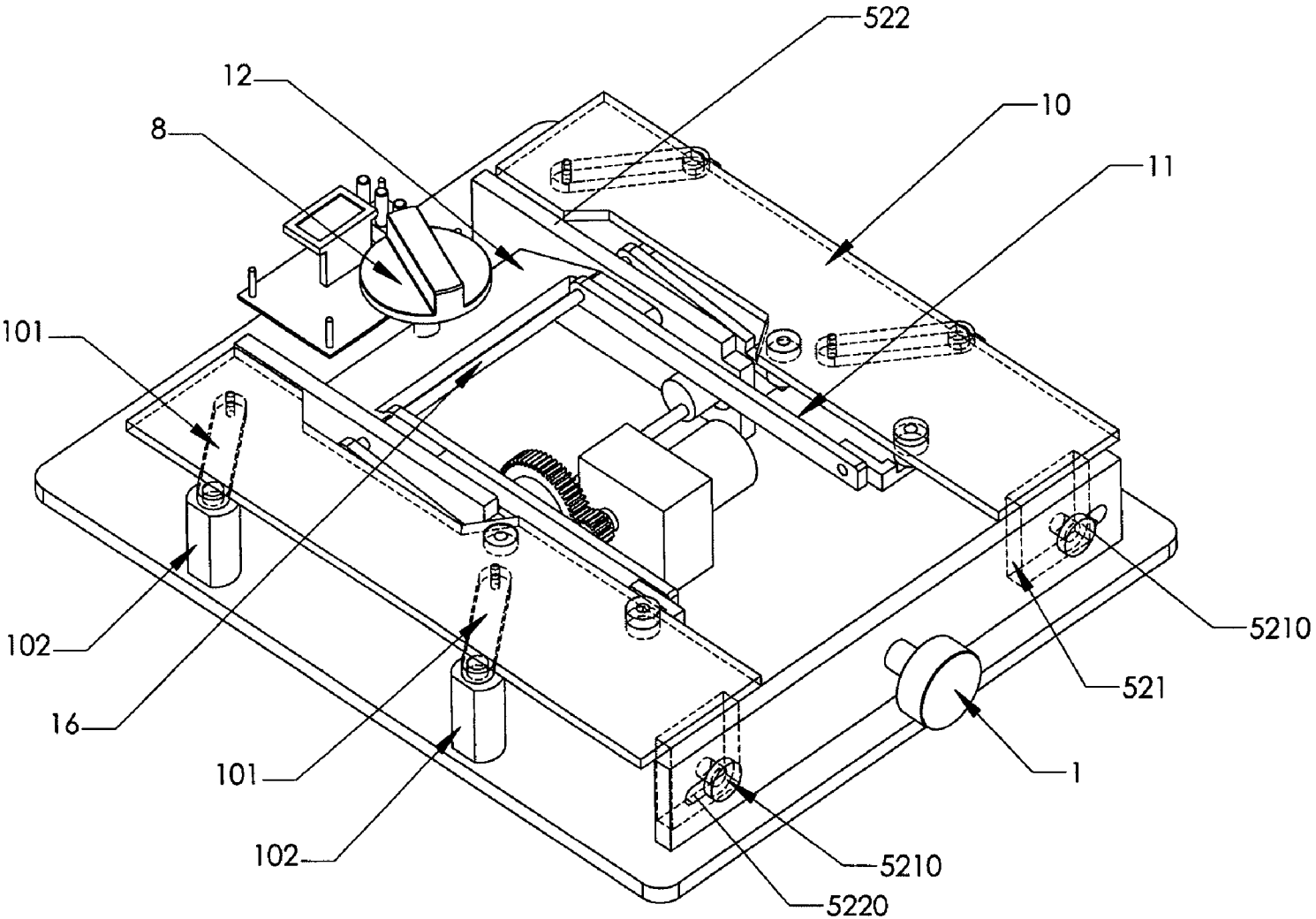
FIG. 4 is a perspective view illustrating the connection relationship between the horizontally movable plates and the surrounding components in the housing.

Please refer to FIG. 1 to FIG. 4 firstly. FIG. 1 is a perspective view illustrating a foot massage apparatus 100 according to an embodiment of the present invention; FIG. 2 is a perspective view illustrating the inner structure of the foot massage apparatus 100 shown in FIG. 1, removing the upper plate 51 of the housing 5; and FIG. 3 is a perspective view illustrating the inner structure of the foot massage apparatus 100 shown in FIG. 1, removing the upper plate 51, the horizontally movable plates 10 and the side plates 52. FIG. 4 is a perspective view illustrating the connection relationship between the horizontally movable plates 10 and the surrounding components in the housing 5.

As shown in FIGS. 1 to 4, the foot massage apparatus 100 according to one embodiment of the present invention comprises: a housing 5 in the shape of a rectangular cube formed of an upper plate 51 and four side plates 52 and a bottom plate 53; two replaceable footprint plates 4 placed on the upper plate 51; a number of protrusions 2 and 3 protruding from holes 40 of each replaceable footprint plate 4; an adjustment mechanism (described later) for adjusting the horizontal position and the height of the protrusions; a driving mechanism (described later) for driving the protrusions to move up and down cyclically; several switches 6 for turnon/turnoff, speed control selection and massage duration selection of the foot massage apparatus 100; and the display 7 for showing setting parameters.

Figure 5:
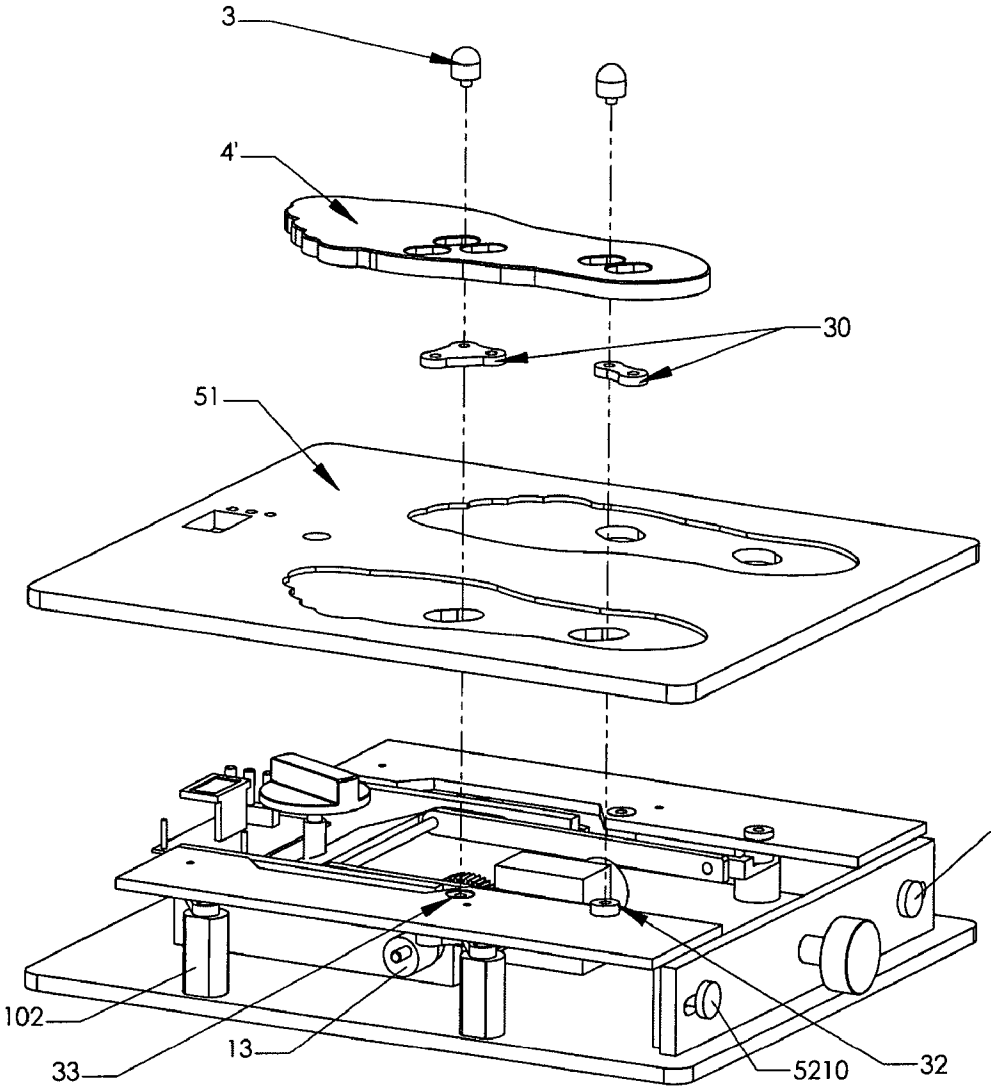
FIG. 5 is a perspective view illustrating how to replace the other foot patterns.

In fact, the foot massage apparatus 100 is equipped with several sets of replaceable assembly for different bodily functions, each of which is composed of the footprint plates 4, protrusion plates 30 and protrusions. The replaceable footprint plate 4 has a number of holes 40 forming a particular foot massage pattern which may be corresponding with a pattern formed of protrusions 2 and 3 located at different reflex zones and the acupoint according to a particular bodily function such as blood circulation, migraine and weight reduction. FIG. 1 to FIG. 3 are for a particular massage pattern. FIG. 5 shows a model in which the massage pattern can be replaced.

In the foot massage apparatus 100, the adjustment mechanism comprises a vertical adjustment mechanism and a horizontal adjustment mechanism. Hereinafter, one embodiment for the vertical adjustment mechanism and the horizontal adjustment mechanism is illustrated in the following description and drawings, but it is obvious that the present invention is not limited to this.

The vertical adjustment mechanism of the foot massage apparatus 100 includes a first adjustment knob 8 which is mounted on upper plate 51 for adjusting the initial height of the protrusions; a pair of first intermediate levers 11, an end of which are provided with an actuator column 32 for supporting protrusions 2 thereon; a pair of second intermediate levers 14, an end of which are provided with an actuator column 33 for supporting the protrusions 3 thereon; a main lever 12 having a side portion against the bottom end of the adjustment knob 8 and having the other side portion rigidly connected with the other end of the first intermediate levers 11 and the other end of the intermediate levers 14 by means of a pivot shaft 16; in which, the bottom end of the first adjustment knob 8 with screw thread is connected to the main lever 12 by means of a nut (not shown) which is mounted on the main lever 12. In addition, there is a slot (not shown) on an intermediate plate 522 so as not to interfere the displacement of the lever assembly of the levers 11, 12 and 14. When the knob 8 is screwed into the housing, the main lever 12 is pushed downward and accordingly the initial height of the protrusions is a little higher. When the knob 8 is screwed out, the main lever 12 is pulled upward and accordingly the initial height of the protrusions is a little lower.

The driving mechanism of the foot massage apparatus 100 includes an electric motor 9, and cams 15 and 13 which are synchronously driven by an electric motor 9, for supporting and thereby driving the first intermediate levers 11 and the second intermediate levers 14. When the cams 15 and 13 are rotated synchronously by the motor 9, the actuator columns 32 and 33 thereby can move up and down cyclically. In addition, the height of the protrusions can be adjusted by changing the resting points of the levers 11 & 14 on the cams 15 & 13 correspondingly.

The horizontal adjustment mechanism of the foot massage apparatus 100 includes a second adjustment knob 1 passing through the side plate 52 and being connected with an inner plate 521, for adjusting the horizontal position of the protrusions in order to suit the different foot sizes; a pair of horizontally movable plates 10, which are connected with the inner plate 521 via two pin elements 5210 passing through ellipse holes of the inner plate 521, and on which is provided with corresponding holes for respectively allowing the actuator columns 32 and 33 with protrusions to protrude therethrough; support columns 102 mounted on the bottom plate 53, for supporting the horizontally movable plates 10; horizontally pivot levers 101, which are pivotedly connected to each of the support columns 102 with an end, and pivotedly connected to the bottom of the horizontally movable plate 10 with the other end. In addition, protrusion plate(s) 30 for mounting different protrusions may be fixed between the actuator columns 32 & 33 and protrusions. Hence, the horizontally movable plates 10 can be moved about the pivot joints and the position of the protrusions can be adjusted horizontally. Also that is the reason why there are two ellipse holes 5220 on the inner plate 521 as it has slight side displacement.

Accordingly, the foot massage apparatus 100 according to the above-mentioned embodiment can directly apply cyclic pressure force on selected points on the soles through protrusions which are activated and adjusted by cooperation motion of levers and cams of the vertical and horizontal adjustment mechanisms and the driving mechanism.

In other words, in this embodiment, one batch of protrusions 2 is activated by the lever 11 and the other batch of protrusions 3 are activated by the lever mechanism 14. Both levers 11 and 14 are driven by cams 15 and 13 which are in turn driven by an electric motor 9. The second adjustment knob 1 is used to adjust the location of protrusions by horizontal movement of the plate 10 in order to suit different foot sizes. The first adjustment knob 8 is used to adjust the initial height of the protrusions by means of the main lever 12. The height of protrusions can vary cyclically with the rotation of the cams 13 and 15. The pattern of the protrusions is corresponding to the pattern of holes 40 on the foot print plate 4 which is a replaceable element. The footprint plate 4 is placed on the upper surface of the housing 5 such that the two batches of protrusions 2 and 3 are rested on the levers 11 & 14. The foot massage effect is provided by continuously applying cyclic pressure on the points on the soles through the protrusions whose up-and-down cyclic motions are driven by the cams.

Now, explanation will be made to illustrate how to replace the other foot massage patterns with reference to FIG. 5.

Protrusion plate 30 of a particular massage pattern may be fixed between the actuator columns 32 & 33 and protrusions 2 & 3 by inserting the bottom end of protrusions 2 & 3 into the actuator columns 32 & 33 via holes in the protrusion plate 30. It is obvious that protrusion plates 30 are suitable for mounting other protrusions as desired massage pattern. By inserting the corresponding footprint plate 4' and protrusions, another massage pattern dealing with a specific bodily function can be assembled. In operation, the up-and-down motion is triggered by the levers 11 and 14 through the actuator columns 32 & 33, the protrusion plates 30 and the protrusions. In case we need to replace another pattern, we can simply replace another set of protrusion plate 30, footprint plate 4 and protrusions 2 or 3. Each massage pattern for the enhancement of a specific bodily function (like weight control, pain relief) is incorporated into one footprint plate which can be easily re-mounted onto the housing.

As can be seen from the above-mentioned embodiments, the foot massage apparatus of the present invention is to provide foot massage effect by directly applying cyclic pressure force on selected points on the soles through protrusions which are activated by adjustment mechanisms. The foot massage apparatus of the present invention is for the enhancement of a particular bodily function and can fit different foot sizes.

What is claimed is:

1. A foot massage apparatus, comprising:

a housing;

a pair of replaceable footprint plates with holes arranged according to a particular foot massage pattern, which are placed on an upper plate of the housing;

protrusions protruding from the holes of each replaceable footprint plate;

a vertical adjustment mechanism provided in the housing, for adjusting the height of the protrusions;

a horizontal adjustment mechanism provided in the housing, for adjusting the horizontal position of the protrusions; and a driving mechanism provided in the housing, for driving the protrusions to move up and down cyclically, wherein the vertical adjustment mechanism includes:

a pair of first intermediate levers, first ends of which are provided with actuator columns for supporting protrusions thereon;

a pair of second intermediate levers, first ends of which are provided with actuator columns for supporting protrusions thereon;

a main lever connected with second ends of the first intermediate levers and second ends of the second intermediate levers by means of a pivot shaft; and a first adjustment knob connected to the main lever, for adjusting the initial height of the protrusions.

2. A foot massage apparatus according to claim 1, wherein a bottom end of the first adjustment knob with screw thread is connected to a nut mounted on the main lever.

3. A foot massage apparatus according to claim 1, wherein the horizontal adjustment mechanism includes a second adjustment knob passing through a side plate of the housing and being connected with inner plates mounted in the housing, for adjusting the horizontal position of the protrusions in order to suit different foot sizes; a pair of horizontally movable plates which are connected with the inner plates and on which are provided with corresponding holes for respectively allowing the actuator columns to protrude therethrough; support columns mounted on a bottom plate of the housing, for supporting the horizontally movable plates; horizontally pivot levers, first ends of which are pivotedly connected to the support columns, and the second ends of which are pivotedly connected to the bottom of the horizontally movable plates.

4. A foot massage apparatus according to claim 3, wherein the horizontally movable plates are connected with the inner plates via pin elements passing through ellipse holes of the inner plates.

5. A foot massage apparatus according to claim 1, wherein the driving mechanism includes an electric motor and cams which are synchronously driven by the electric motor, for supporting and thereby driving the first intermediate levers and the second intermediate levers together with the actuator columns and protrusions mounted thereon to move up and down cyclically.

6. A foot massage apparatus according to claim 1, wherein protrusion plates with the corresponding massage pattern are further fixed between the actuator columns and the protrusions by inserting bottom ends of the protrusions into the actuator columns through holes in the protrusion plates.

* * * * *